United States Patent [19]

Barnard et al.

[11] 4,198,831

[45] Apr. 22, 1980

[54] ICE MAKER

[75] Inventors: Walter C. Barnard, White Bear Lake; Norbert E. Venne, St. Paul, both of Minn.

[73] Assignee: Whirlpool Corporation, Benton Harbor, Mich.

[21] Appl. No.: 868,401

[22] Filed: Jan. 9, 1978

[51] Int. Cl.[2] ..... F25C 1/14

[52] U.S. Cl. ..... 62/320; 62/354; 225/98

[58] Field of Search ..... 62/320, 354; 225/93, 225/98; 241/DIG. 17

[56] References Cited

U.S. PATENT DOCUMENTS

| | | | |
|---|---|---|---|
| 2,387,899 | 10/1945 | Gruner | 62/320 X |
| 2,397,347 | 3/1946 | Gruner | 62/320 |
| 2,648,955 | 8/1953 | Lee et al. | 62/320 X |
| 3,141,592 | 7/1964 | Glynn et al. | 225/98 |
| 3,654,770 | 4/1972 | Clearman | 62/320 |
| 3,662,564 | 5/1972 | Clearman et al. | 62/320 |
| 3,896,631 | 7/1975 | Morrison | 62/320 X |
| 3,930,376 | 1/1976 | Schwartz | 62/320 |
| 4,063,761 | 12/1977 | Pansini | 285/275 |

*Primary Examiner*—Albert J. Makay
*Assistant Examiner*—William E. Tapolcai, Jr.
*Attorney, Agent, or Firm*—Wegner, Stellman, McCord, Wiles & Wood

[57] ABSTRACT

An ice maker having structure for forming an ice column which is passed through a constricting nozzle. A delivery structure is arranged to receive the ice column and cause selectively the shearing of the ice column into full sized ice bodies, approximately half size ice bodies, or cracked ice. The delivery structure may include a breaker tube having an inwardly directed projection and defining a deflecting structure for shearing the ice at preselected intervals. The delivery structure may further include a selectively installable adapter defining a second inwardly directed projection for causing shearing of the ice column at preselected intervals less than that effected by the projection in the breaker tube. A blade may be removably associated with the adapter for selectively causing shattering of the ice column so as to form cracked ice, when desired. An extension tube may be associated with the breaker tube for delivering the ice bodies and cracked ice in any direction from the ice maker.

17 Claims, 6 Drawing Figures

ICE MAKER

BACKGROUND OF THE INVENTION

1. Field of the Invention

This invention relates to ice makers and in particular to means for converting a column of ice formed in an automatic ice maker selectivity to ice products in any one of a plurality of different configurations.

2. Description of the Prior Art

The present invention comprises an improveent in auger-type ice makers. One such auger-type ice maker is shown in U.S. Pat. No. 3,648,462 of John B. Lyman, which patent is owned by the assignee hereof. As shown therein, the ice maker includes a cover member defining a collection chamber for receiving ice flakes or slush harvested from a refrigerated surface. In the Jack f. Clearman et al patent U.S. Pat. No. 3,662,564, also owned by the assignee hereof, a number of different extrusion members are removably secured at an outermost end of the screw shaft to adapt the machine for producing differently configured ice products. The delivery tube is generally cyclindrical and the extrusion members are mounted to extend upwardly within the lower end of the delivery tube.

The Turner et al U.S. Pat. No. 3, 678,702, owned by the assignee hereof, illustrates, in FIG. 8, a prior art form of breaker elbow utilized in such an auger-type ice maker to effect the desired breaking of the column of ice into discrete portions.

In U.S. Pat. No. 3,733,844 of Phillip H. Turner, which patent is owned by the assignee hereof, the compressed column of hard ice is impacted against a knife means to cause the formation of cracked ice therefrom.

In the John Franklin Morrison U.S. Pat. No. 3,896,631, owned by the assignee hereof, the ice is cracked by a knife blade and then the cracked ice reforms into a column which advances at a generally uniform rate of flow through a discharge duct.

In U.S. Pat. No. 4,040,267 of Donald F. Swanson, owned by the assignee hereof, a breaker elbow is provided which includes an upwardly angled portion tending to shear the column of ice as it is delivered into the elbow. The ice cubes are delivered in the direction determined by the angle of the breaker elbow.

Aaron Lee et al, in U.S. Pat. No. 2,595,588, show an ice making machine wherein the column of ice engages an angled breaker plate to break the column of ice into pieces of predetermined small size.

Aaron Lee et al, in U.S. Pat. No. 2,648,955, teach the use of a knife aligned with the center of the column of ice to crush or crack the ice as it is moved upwardly thereagainst.

Dave C. Smith et al, in U.S. Pat. No. 3,197,974, show an auger-type chip making machine having indentations in the delivery portion for preventing rotation of the ice column. The unit provides small ice flakes and particles which are wiped off the wall of the shell and moved upwardly by a spiral to form shapeless slush ice into a tubular column of soft ice which is rotated with the rotation of the spiral. to form shapeless slush ice into a tubular column of soft ice which is rotated with the rotation of the spiral.

In U.S. Pat. No. 3,803,869 of Charles G. Neumann et al, a plate-type ice maker is disclosed having a cutting edge at one end of an ice-forming passage member which is moved over a plane freezing surface by the cutting edge to be forced into the forming passage in which they are subjected to compressive forces to form a rod of hard ice. At the other end of the passage is a breaker surface which fractures the rod to form discrete pieces of ice.

SUMMARY OF THE INVENTION

The present invention comprehends an improved ice maker of the type wherein a column of hard ice is formed by augering the ice through a constricting nozzle. The invention comprehends providing a breaker tube receiving the hard ice column for longitudinal movement of the column therethrough along a preselected path. The breaker tube passage has a cross section larger than that of the ice column delivered from the nozzle so as to permit the ice column to be spaced inwardly of a first sidewall portion of the breaker tube.

A second inwardly projecting sidewall portion of the breaker tube is disposed generally oppositely of the first sidewall portion and projects into the path of movement of the ice column to define a deflecting means arranged to cause a sufficient deflection of the hard ice in the column to shear the column at spaced intervals, thereby forming the hard ice column into a series of discrete ice bodies.

The invention further comprehends the provision in such an ice maker of a selectively removable means intermediate the nozzle and the inwardly projecting wall portion for causing shearing of the ice column at spaced intervals less than the spaced intervals provided by the inwardly projecting wall portion. The selectively removable means thereby provides ice bodies of smaller preselected size. In the illustrated embodiment, the inwardly projecting wall portion provides ice bodies of substantially cubical shape whereas the removable means provides ice bodies of approximately one-half cubical shape.

The removable means may comprises an adapter having a flange projecting into the path of movement of the ice column at a position intermediate the nozzle and the inwardly projecting breaker tube wall portion.

The selectively removable means may define a blade extending transversely across the delivery passage with the flat dimension of the blade parallel to the longitudinal extent of the passage for shattering the ice column moving therepast. The blade may be removably secured to the adapter plate provided with the above discussed flange to provide selectively either partial size ice bodies or cracked ice, as desired.

The breaker tube may be provided with an extension duct movably mounted to an upper end thereof and having a discharge end selectively positionable about a vertical axis of the ice maker structure for delivery of ice to a remote location. The extension duct may comprise a U-shaped element, and in the illustrated embodiment, the discharge leg of the U-shaped element is substantially longer than the leg connected to the delivery duct.

Thus, the invention comprehends an improved ice maker structure having novel means for selectively providing ice bodies, partial ice bodies, or cracked ice, as desired, and delivering the ice product in any direction from the upwardly extending delivery duct. The ice maker structure of the invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
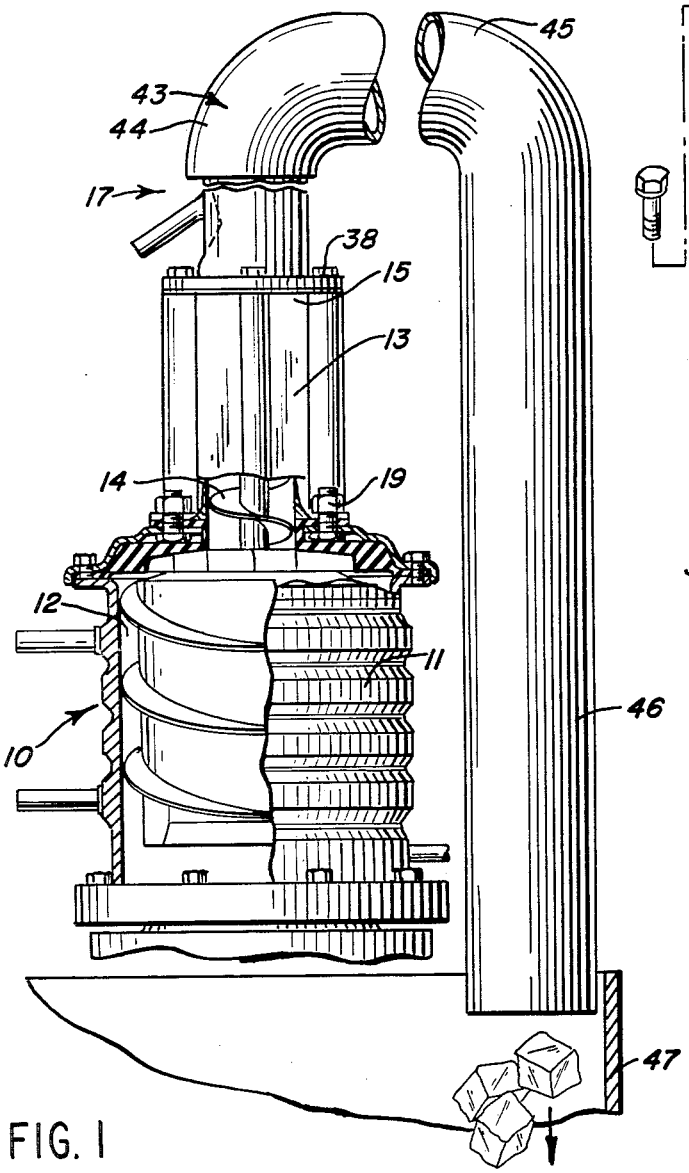
FIG. 1 is a fragmentary side elevation of an ice maker structure embodying the invention with portions broken away to facilitate illustration of the invention.

In the illustrated embodiment of the invention as disclosed in the drawing, an auger-type ice maker generally designated 10 includes an ice-forming portion 11 which delivers a mixture of ice particles upwardly from a chamber 12 therein which is suitably cooled to form a thin film of ice on he chamber wall. Extending upwardly from the ice-forming portion 11 is an extrusion nozzle 13 provided with a compression auger 14 which forcibly urges the ice particles upwardly through an upper end portion 15 thereof. The forceful urging of the ice particles squeezes the ice particles in the nozzle bore to remove excess water and form the ice particles into a hard column of ice 16.

An excellent illustration of such an ice maker structure is shown in the Turner et al U.S. Pat. No. 3,678,702, discussed above, to which patent reference may be had for a detailed discussion of the structure of the ice maker structure for providing the desired ice column 16. The present invention is concerned with means for forming desired ice products from the column and comprises means generally designated 17 mounted to the upper end 15 of the nozzle 13, as shown in FIG. 1.

Figure 2:
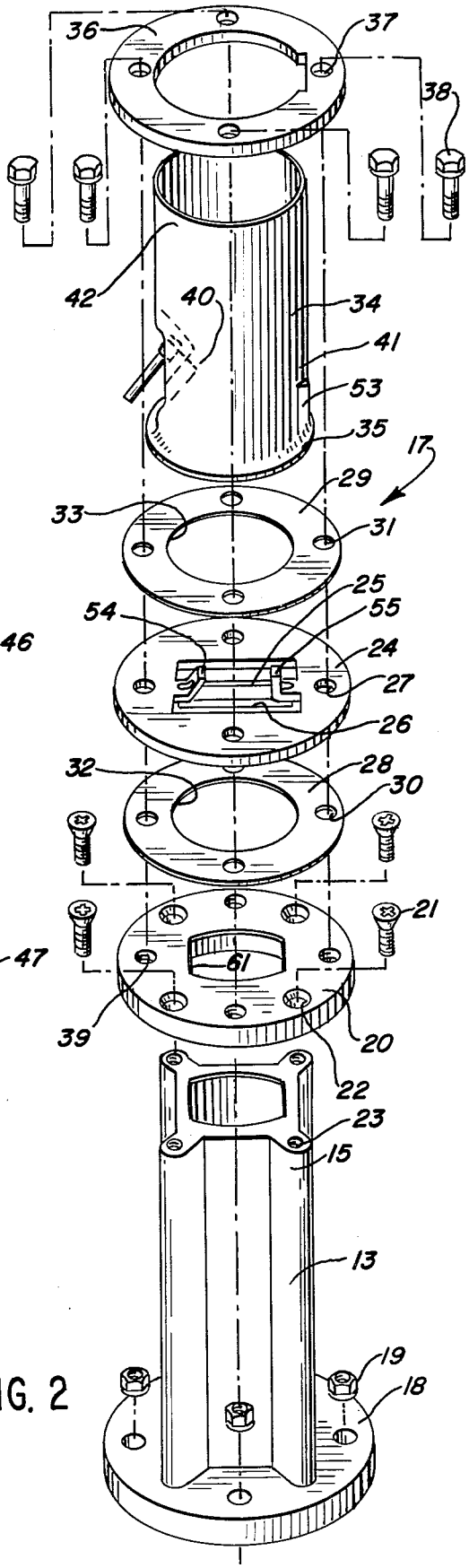
FIG. 2 is an exploded perspective view of a portion of the ice maker structure.
Figure 6:
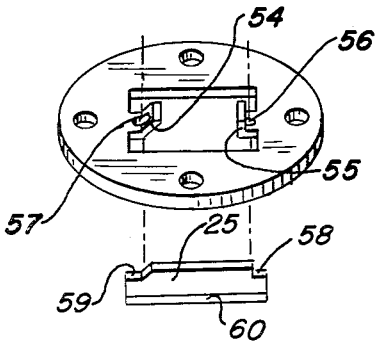
FIG. 6 is an exploded view of the adapter and removable blade assembly for selectively providing the half size ice bodies and cracked ice, as illustrated in FIGS. 4 and 5.

As shown in FIG. 2, the nozzle 13 includes a base flange 18 which may be secured to the ice-forming means 11 by suitable nuts 19. A breaker plate 20 is secured to the upper end 15 of the nozzle by suitable screws 21 and defines a generally square outlet opening 61 through which the ice column 16 is forced from the nozzle.

As shown in FIG. 2, screws 21 extend through suitable holes 22 in the breaker plate and are threaded into corresponding threaded holes 23 in the upper end of the nozzle.

With further reference to the complete assembly of FIG. 2, where the ice maker is arranged to provide cracked ice, the assembly further includes an adapter plate 24 carrying a blade 25 across a central square opening 26. The adapter plate is further provided with a plurality of bolt passing holes 27.

A lower gasket 28 and an upper gasket 29 are provided below and above the adapter plate and are provided respectively with bolt passing holes 30 and 31. Gasket 28 is provided with a central opening 32 and gasket 29 is provided with a corresponding central opening 33.

A breaker tube 34 is mounted above the nozzle 13 and more specifically, is provided with a lower flange portion 35 which is clamped to the gasket 29 by a mounting ring 36 having a plurality of bolt passing holes 37. The mounting ring is secured to the breaker plate 20 by a plurality of bolts 38 which extend downwardly through the mounting ring holes 37, gasket holes 31, adapter plate holes 27, and gasket hole 30 into threaded holes 39 in the breaker plate.

The breaker tube includes an indent portion 40 disposed diametrically opposite a sidewall portion 41 adjacent the lower end thereof.

As shown in FIG. 1, the upper end 42 of the breaker tube may be provided with a swivelly mounted discharge tube 43 having a short leg 44 swivelly mounted to the breaker tube, a bight portion 45, and a downturned long leg 46 adapted to deliver the ice to a subjacent collecting bin 47. The swivel mounting of the discharge tube 43 permits the discharge to be in any laterally related direction from the ice maker to provide improved facilitated ice body delivery.

Figure 3:
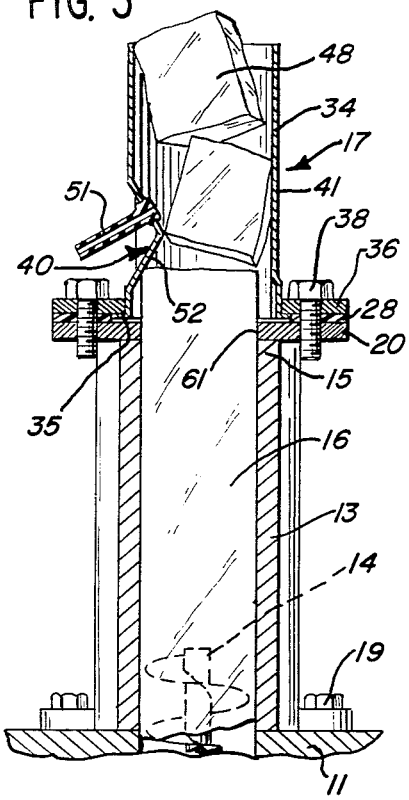
FIG. 3 is a fragmentary vertical section illustrating the arrangement of the structure for providing ice bodies.
Figure 4:
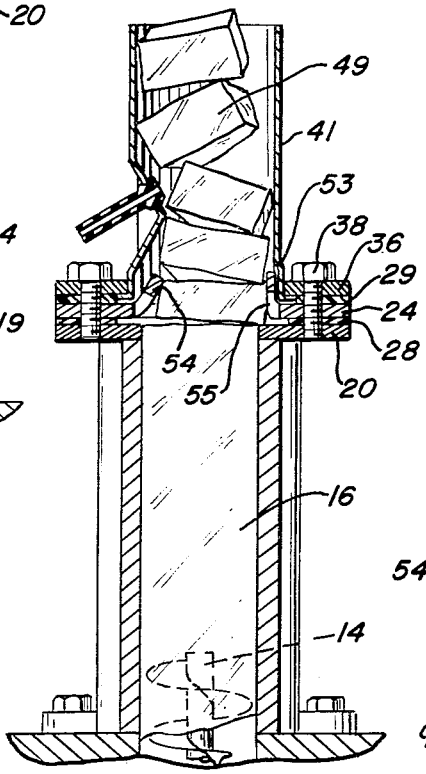
FIG. 4 is a vertical section illustrating the arrangement of the structure for providing half size ice bodies.
Figure 5:
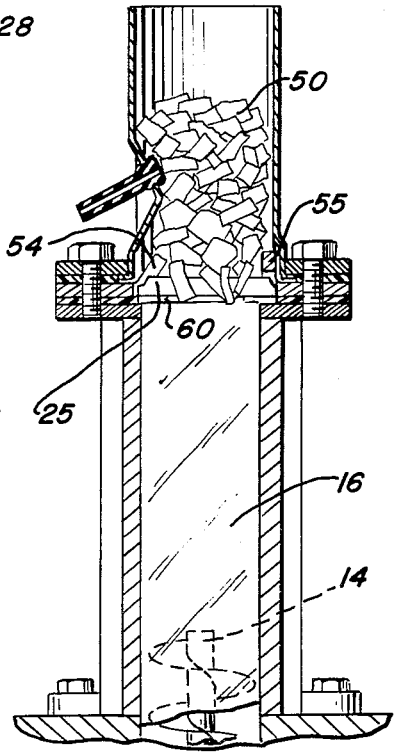
FIG. 5 is a vertical section illustrating the arrangement for providing cracked ice.

The ice maker of the present invention is arranged to provide selectively either full size cube-form ice bodies 48, as shown in FIG. 3, half size ice bodies 49, as shown in FIG. 4, or cracked ice 50, as shown in FIG. 5. As discussed briefly above, in forming the cracked ice 50, the ice make utilizes the adapter plate 24 and blade 25. In forming the full size ice bodies, the adapter plate and blade are omitted, as shown in FIG. 3, with the flange portion 35 of the breaker tube 34 being clamped directly through a single gasket 28 to the breaker plate 20 by the mounting ring 36 and bolts 38.

As shown in FIG. 3, the ice column 16, in moving upwardly from the nozzle 13 through opening 61, is urged against the indent portion 40 of the breaker tube, which displaces the upper end of the ice column 16 to the right, as seen in FIG. 3, against the opposing wall portion 41 to effect a shearing action breaking free from the top of the ice column the respective ice bodies 48 seriatim in the continual upward delivery of the ice column in the ice maker operation.

As further shown in FIG. 3, the indent portion 40 of the breaker tube may be provided with a drain tube 51 for draining any melt which may form within the breaker tube in the operation of the ice maker.

As shown in FIG. 3, indent 40 defines an upwardly inclined wall surface 52 against which the upper end of the ice column impinges in the operation of the ice maker. The inclined surface 52 deflects the ice column until it becomes sheared, providing a relatively clean break in forming the ice bodies 48, as shown in FIG. 3. The ice bodies 48, as illustrated in FIG. 3, effectively comprise cubic-shaped ice bodies wherein the length of the ice bodies in the longitudinal direction of the ice column 16 is substantially equal to the width and depth of the ice bodies as defined by the effective square nozzle cross section. More specifically, the location of the indent portion 40 of the breaker tube is preselected to shear the ice column transversely thereto at a position spaced from the nozzle a distance substantially equal to the length of one side of the square nozzle cross section. Thus, as shown in FIG. 3, the resulting ice bodies sheared from the column 16 are effectively cubic, full-size ice bodies.

Referring now to FIG. 4, the formation of the half size ice bodies 49 is effected by use of the adapter plate 24 which, as shown, may be installed between the breaker plate 20 and mounting ring 36 and gaskets 28 and 29, respectively.

The lower end of the breaker tube may be provided with an offset portion 53 subjacent the wall portion 41. The adapter plate includes an angled flange 54 at one end of opening 26 and an upright flange 55 at the other end of the opening 26. Upright flange 55 is received in the offset portion 53 of the delivery tube to accurately position the adapter plate in alignment with the breaker plate opening 22 of the nozzle 13.

Thus, as shown in FIG. 4, when the ice column 16 impinges on the inclined flange 54, the ice column is urged against the lower edge of flange 55 to cause the shearing of the ice column into half size ice bodies 49. As shown in FIG. 4, the ice bodies 49 are cleanly broken from the ice column by the shearing action of the flange 54.

The improved shearing action of the indent wall surface 52 and the flange 54 provide uniform size ice bodies in both the full size and half size forms, as shown in FIGS. 3 and 4, so as to provide an improved ice product to the collecting bin 47, as desired.

As the adapter plate may be readily installed in the ice maker by the readily removable bolts 38, the ice maker is adapted for facilitated selective use in forming such different size ice bodies.

As further discussed above, the ice maker is further adapted to provide selectively cracked ice 50, when desired. For this purpose, the adapter plate is provided with notches 56 and 57 in flanges 53 and 54, respectively, for receiving corresponding notch portions 58 and 59 of the blade 25. Lower edge 60 of the blade defines a sharp cutting edge which, when impinged on by the upper end of the ice column, breaks the ice column into relatively small pieces, as shown in FIG. 5.

Thus, the ice maker 10 is readily adapted for selective provision of either full size ice pieces 48, half size ice pieces 49, or cracked ice 50, as desired, by the simple interchangeability of the adapter plate and blade. In the illustrated embodiment, the breaker tube, adapter plate and blade may be formed of stainless steel for long, troublefree life. The invention comprehends the use of a single size breaker tube while yet providing the three different forms of ice as discussed above. As discussed, the ice maker utilizes a small number of components to provide the selective ice delivery and may be readily converted to provide any of the desired ice products.

The swivel arrangement of the discharge tube permits a universal delivery of the ice products in virtually any direction for further facilitated ice making.

In the illustrated embodiment, the breaker tube had a diameter of approximately 1½ inches and, thus, comprises a relatively compact structure adapted for facilitated handling by the user in maintenance and sanitation of the device.

The accurate positioning of the bolt passing holes and threaded bolt holes 23 assures the preselected alignment of the elements of the device, as discussed above, thereby further facilitating the assembly of the device in each of the three different modes.

The foregoing disclosure of specific embodiments is illustrative of the broad inventive concepts comprehended by the invention.

Having described the invention, the embodiments of the invention in which an exclusive property or privilege is claimed are defined as follows:

1. In an ice maker having means for forming ice, means defining a constricting nozzle, and means for urging the ice through the nozzle to form a solid column of hard ice, the improvement comprising:

a breaker tube defining a delivery passage disposed to receive the ice column for longitudinal movement therethrough along a preselected path, said delivery passage having a cross section larger than that of the ice column permitting the ice column moving from the nozzle to be spaced inwardly of a first sidewall portion of the tube; and a second, inwardly projecting sidewall portion of the breaker tube disposed generally oppositely of said first sidewall portion and projecting into said path of movement of the ice column to define deflecting means arranged to cause a sufficient deflection of the hard ice in said column to shear the column at spaced intervals thereby forming the hard ice into a series of discrete ice bodies, said second sidewall portion of the breaker tube comprising an indented portion of the tube.

2. The ice maker structure of claim 1 wherein said first and second sidewall portions of the breaker tube are disposed adjacent the nozzle.

3. The ice maker structure of claim 1 wherein said nozzle defines a substantially rectangular cross section and said deflecting means causes a shearing of the ice column substantially transversely thereto whereby said ice bodies comprise substantially parallelepiped ice bodies.

4. The ice maker structure of claim 1 wherein said nozzle defines a substantially square cross section and said deflecting means causes a shearing of the ice column substantially transversely thereto whereby said ice bodies comprise substantially cubic shape ice bodies.

5. The ice maker structure of claim 1 wherein said nozzle defines a substantially square cross section and said deflecting means causes a shearing of the ice column substantially transversely thereto at a position spaced from said nozzle a distance substantially equal to the length of one side of said square nozzle cross section, whereby said ice bodies comprise substantially cubic shape ice bodies.

6. The ice maker structure of claim 3 further including selectively removable means fixedly mounted intermediate said nozzle and said inwardly projecting sidewall portion for causing shearing of the ice column in said delivery passage at second spaced intervals less than said first named spaced intervals and precluding shearing of the ice column by said inwardly projecting sidewall portion.

7. The ice maker structure of claim 6 wherein said selectively removable means comprises an adapter plate having a flange projecting into said path of movement of the ice column to define a second deflecting means in said delivery passage for deflecting said ice column toward said first sidewall portion.

8. The ice maker structure of claim 6 wherein said selectively removable means comprises an adapter plate having a flange projecting into said path of movement of the ice column to define a second deflecting means in said delivery passage for deflecting said ice column toward said first sidewall portion, said flange engaging said ice column at a position approximately midway between said inwardly projecting sidewall portion of the breaker tube and said nozzle to provide sheared ice bodies having a length approximately one-half that of ice bodies sheared from the ice column by said inwardly projecting sidewall portion as upon removal of said adapter plate from said ice maker structure.

9. The ice maker structure of claim 3 further including a blade extending transversely across said delivery passage intermediate said nozzle and said inwardly projecting portion with the flat dimension of said blade parallel to the longitudinal extend of the passage for shattering the ice column moving therepast to form cracked ice.

10. The ice maker structure of claim 9 further including an adapter plate and means for removably securing said blade to said adapter plate.

11. The ice maker structure of claim 3 further including an extension duct movably mounted to said breaker tube upstream of said sidewall portions and having a discharge end selectively positionable about a vertical axis for controlled delivery of said ice bodies from said breaker tube.

12. The ice maker structure of claim 11 wherein said extension duct includes an inlet portion swivelly mounted to said breaker tube upper end.

13. The ice maker structure of claim 11 wherein said extension duct is U-shaped, one leg of said U-shaped duct being swingably mounted to said breaker tube upper end.

14. The ice maker structure of claim 11 wherein said extension duct is U-shaped, one leg of said U-shaped duct being swingably mounted to said breaker tube upper end and the other leg having a length substantially greater than that of said one leg.

15. In an ice maker having means for forming ice, means defining a constricting nozzle, and means for urging the ice through the nozzle to form a solid column of hard ice, the improvement comprising:

a breaker tube defining a delivery passage disposed to receive the ice column for longitudinal movement therethrough along a preselected path, said delivery passage having a cross section larger than that of the ice column permitting the ice column moving from the nozzle to be space inwardly of a first sidewall portion of the tube;

a second, inwardly projecting sidewall portion of the breaker tube disposed generally oppositely of said first sidewall portion and projecting into said path of movement of the ice column to define deflecting means arranged to cause a sufficient deflection of the hard ice in said column to shear the column at spaced intervals thereby forming the hard ice into a series of discrete ice bodies; and selectively removable means intermediate said nozzle and said inwardly projecting portion defining a blade extending transversely across said delivery passage with the flat dimension of said blade parallel to the longitudinal extent of the passage for shattering the ice column moving therepast to form cracked ice, said selectively removable means including an adapter plate and means for removably securing said blade to said adapter plate, said adapter plate further having a flange projecting in said path of movement adjacent one end of said blade, and shoulder means opposite said flange adjacent the other end of said blade.

16. In an ice maker having means for forming ice, means defining a constricting nozzle, and means for urging the ice through the nozzle to form a solid column of hard ice, the improvement comprising:

a breaker tube defining a delivery passage disposed to receive the ice column for longitudinal movement therethrough along a preselected path, said delivery passage having a cross section larger than that of the ice column permitting the ice column moving from the nozzle to be spaced inwardly of a first sidewall portion of the tube;

a second, inwardly projecting sidewall portion of the breaker tube disposed generally oppositely of said first sidewall portion and projecting into said path of movement of the ice column to define deflecting means arranged to cause a sufficient deflection of the hard ice in said column to shear the column at first spaced intervals thereby forming the hard ice into a series of discrete ice bodies; and selectively removable means intermediate said nozzle and said inwardly projecting wall portion for causing shearing of the ice column in said delivery passage at second spaced intervals less than said first spaced intervals and precluding shearing of the ice column by said inwardly projecting sidewall portion, said selectively removable means comprising an adapter plate having a flange projecting into said path of movement of the ice column to define a second deflecting means in said delivery passage for deflecting said ice column toward said first sidewall portion, and shoulder means on said adapter plate opposite said flange for engagement by said ice column transversely of said flange to provide improved shearing of the ice column.

17. In an ice maker having means for forming ice, means defining a constricting nozzle, and means for urging the ice through the nozzle to form a solid column of hard ice, the improvement comprising:

a breaker tube defining a delivery passage disposed to receive the ice column for longitudinal movement therethrough along a preselected path, said delivery passage having a cross section larger than that of the ice column permitting the ice column moving from the nozzle to be spaced inwardly of a first sidewall portion of the tube;

a second, inwardly projecting sidewall portion of the breaker tube disposed generally oppositely of said first sidewall portion and projecting into said path of movement of the ice column to define deflecting means arranged to cause a sufficient deflection of the hard ice in said column to shear the column at spaced intervals thereby forming the hard ice into a series of discrete ice bodies; and selectively removable means intermediate said nozzle and said inwardly projecting portion defining a blade extending transversely across said delivery passage with the flat dimension of said blade parallel to the longitudinal extent of the passage for shattering the ice column moving therepast to form cracked ice, said selectively removable means including an adapter plate and means for removably securing said blade to said adapter plate, said adapter plate further having a flange projecting in said path of movement adjacent said blade.

* * * * *